US010655824B1

(12) United States Patent
Wei

(10) Patent No.: US 10,655,824 B1
(45) Date of Patent: May 19, 2020

(54) FIXING STRUCTURE FOR LIGHT STRIP

(71) Applicant: PAOKAI ELECTRONIC ENTERPRISE CO., LTD., Kaohsiung (TW)

(72) Inventor: Ming-Shan Wei, Kaohsiung (TW)

(73) Assignee: PAOKAI ELECTRONIC ENTERPRISE CO., LTD., Kaohsiung (TW)

( * ) Notice: Subject to any disclaimer, the term of this patent is extended or adjusted under 35 U.S.C. 154(b) by 0 days.

(21) Appl. No.: 16/276,129

(22) Filed: Feb. 14, 2019

(51) Int. Cl.

| | |
|---|---|
| ***F21V 21/005*** | (2006.01) |
| ***F21S 4/20*** | (2016.01) |
| ***F21V 3/04*** | (2018.01) |
| ***F21V 17/16*** | (2006.01) |
| ***F21V 17/00*** | (2006.01) |
| *F21W 121/00* | (2006.01) |

(52) U.S. Cl.
CPC ..... *F21V 21/005* (2013.01); *F21S 4/20* (2016.01); *F21V 3/049* (2013.01); *F21V 17/002* (2013.01); *F21V 17/16* (2013.01); *F21W 2121/00* (2013.01)

(58) Field of Classification Search
CPC ..... F21S 4/20; F21S 4/22; F21S 4/24; F21S 4/26; F21S 4/28; F21V 21/005; F21V 17/002; F21V 17/16; F21V 17/164; F21V 3/049; F21W 2121/00
See application file for complete search history.

(56) References Cited

U.S. PATENT DOCUMENTS

| | | | | |
|---|---|---|---|---|
| 6,361,186 | B1 * | 3/2002 | Slayden | F21V 3/02 362/241 |
| 10,344,925 | B2 * | 7/2019 | Siltanen | G02B 6/0073 |
| 2005/0195603 | A1 * | 9/2005 | Hulse | F21S 4/20 362/246 |
| 2014/0362574 | A1 * | 12/2014 | Barrett | F21S 2/00 362/249.03 |
| 2016/0053973 | A1 * | 2/2016 | Tress | F21S 4/28 362/217.02 |
| 2017/0023192 | A1 * | 1/2017 | Moita | F21V 31/03 |
| 2018/0153328 | A1 * | 6/2018 | Girard | E04F 15/02161 |

FOREIGN PATENT DOCUMENTS

| | | |
|---|---|---|
| CN | 205979311 | 2/2017 |
| TW | M419189 U1 | 12/2011 |

* cited by examiner

*Primary Examiner* — Alan B Cariaso
(74) *Attorney, Agent, or Firm* — WPAT, PC

(57) ABSTRACT

A fixing structure for a lighting strip is provided to improve upon the inconvenience in repair of the conventional fixing structure for a light strip. The fixing structure for the lighting strip includes a case provided with a groove, a lighting assembly located in the groove, and a light guiding member received in the groove and covering the lighting assembly.

4 Claims, 6 Drawing Sheets

FIXING STRUCTURE FOR LIGHT STRIP

BACKGROUND OF THE INVENTION

1. Field of the Invention

The present invention generally relates to a fixing structure for a light strip and, more particularly, to a fixing structure for a light strip which allows for convenient repair.

2. Description of the Related Art

FIG. 1 shows a conventional fixing structure for a light strip 9. The conventional fixing structure for a light strip 9 includes a sleeve 91 and a flexible light strip 92. The sleeve 91 includes a light-permeable surface 911 in the form of an arch. The flexible light strip 92 is located in a channel 912 of the sleeve 91 and is aligned with the light-permeable surface 911. In this regard, the light of the flexible light strip 92 can be emitted through the light-permeable surface 911. An example of such a conventional fixing structure for a light strip 9 is disclosed in China Patent No. 205979311 entitled "soft lamp area of T type banding strip with stopping barb."

In the conventional fixing structure for a light strip 9 mentioned above, the flexible light strip 92 extends into the channel 912 from an end of the sleeve 91. Thus, when a part of the flexible light strip 92 is broken and requires repair, the entire flexible light strip 92 should be withdrawn from the channel 912 for repair purpose. After the repair is finished, the flexible light strip 92 needs to be inserted back into the channel 912. Therefore, the entire repair and assembly process is troublesome and increases the cost, leading to a low operational efficiency.

In light of this, it is necessary to improve the conventional fixing structure for a light strip.

SUMMARY OF THE INVENTION

It is therefore the objective of this invention to provide a fixing structure for a light strip with a reduced complexity in assembly or maintenance, leading to a convenient assembly and maintenance.

It is another objective of this invention to provide a fixing structure for a light strip with a reduced cost.

It is a further objective of this invention to provide a fixing structure for a light strip with an enhanced connection strength.

It is yet a further objective of this invention to provide a fixing structure for a light strip with a convenient assembly.

In an aspect, a fixing structure for a light strip according to an embodiment of the invention includes a case provided with a groove, a lighting assembly located in the groove, and a light guiding member. The light guiding member is received in the groove and is covering the lighting assembly.

Accordingly, the fixing structure of the light strip according to the present invention does not require that the entire lighting assembly be pulled out for repair or replacement purposes by providing a light guiding member which is received in the groove and covers the lighting assembly. Thus, the complexity in assembly or maintenance of the fixing structure for the light strip and the labor cost are reduced, leading to a convenient assembly and maintenance.

In an example, the case includes a base and two side plates. The two side plates respectively connect to two long sides of the base. The groove is delimited by the base and the two side plates. Thus, the structure is simple for convenient assembly.

In the example, the base and the two side plates are integrally formed with each other. Thus, the base is securely connected to the two side plates, enhancing the structural strength of the case.

In the example, the light guiding member includes a force-applied portion and an insertion portion. The force-applied portion abuts tops of the two side plates, and the insertion portion abuts two inner faces of the two side plates. Thus, the structure is simple for convenient manufacture, reducing the cost.

In the example, the groove has a depth, and the insertion portion has a height smaller than the depth. Thus, the insertion portion is prevented from making contact with the lighting assembly, which provides a protection for the lighting assembly.

In the example, the light guiding member further includes a hollow portion located in the insertion portion. Thus, the insertion portion is flexible and can be inserted into the groove more smoothly, leading to a convenient assembly.

In the example, two sides of the insertion portion are respectively provided with two stopper structures. The two stopper structures respectively abut the two inner faces of the two side plates. Thus, the light guiding member is firmly received in the groove to close up the groove, preventing the light guiding member from sliding relatively to the two side plates.

In the example, the light guiding member is made of foggy acrylic material. Thus, it is convenient to obtain the material, which reduces the cost.

In the example, the lighting assembly is formed by a plurality of lighting strips connected to each other in series. Thus, only one of the plurality of lighting strips needs to be replace as it is broken, which reduces the repairing cost.

In the example, two ends of each of the plurality of lighting strips are respectively provided with two connecting portions. One of the two connecting portions of one of the plurality of lighting strips is welded with one of the two connecting portions of another of the plurality of lighting strips adjacent to the one of the plurality of lighting strips. Thus, the two adjacent lighting strips are firmly connected to each other, leading to a convenient maintenance and replacement and enhancing the connection strength.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
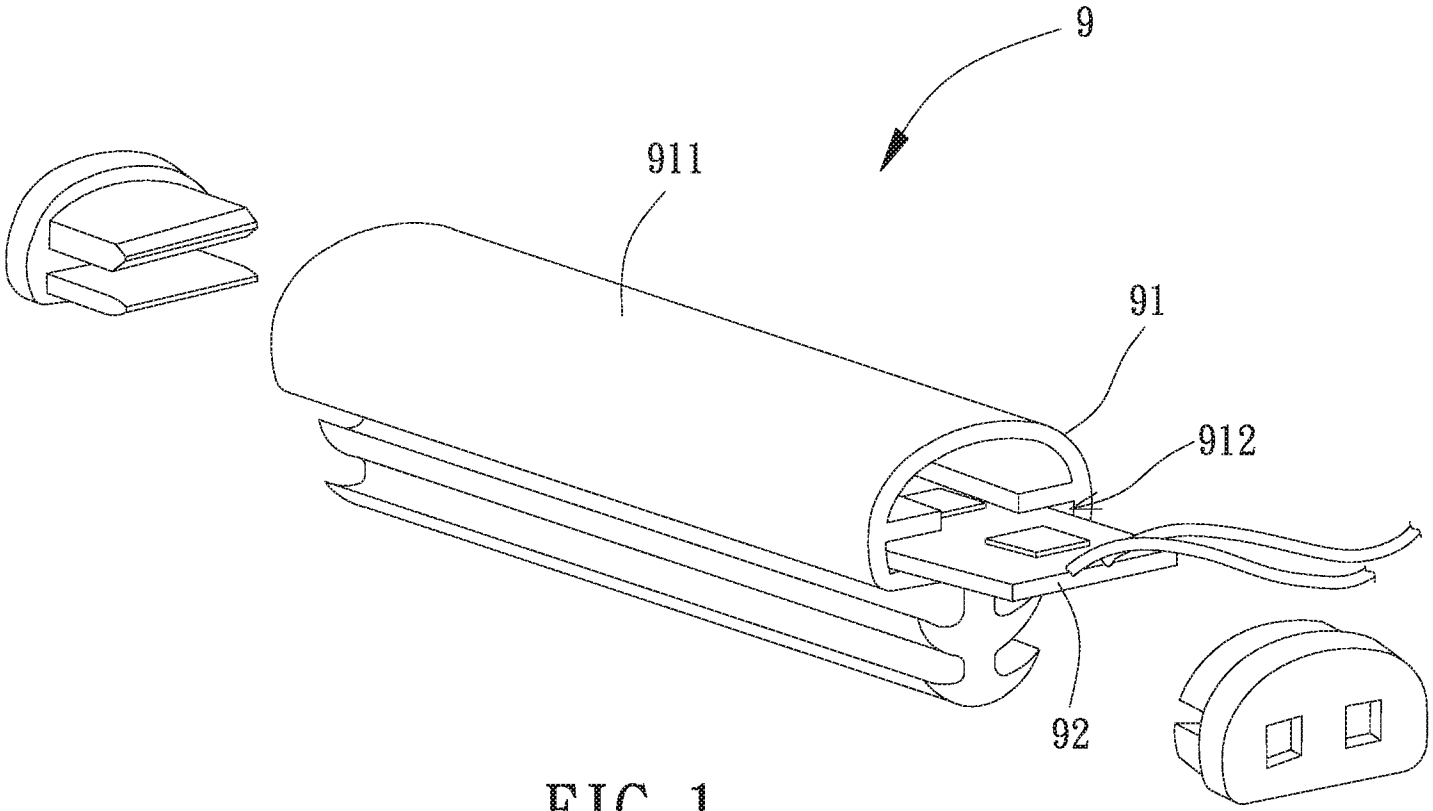
FIG. 1 PRIOR ART
FIG. 1 is a perspective view of a conventional fixing structure for a light strip.

In the various figures of the drawings, the same numerals designate the same or similar parts. Furthermore, when the term "inner", "top", "side" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 2:
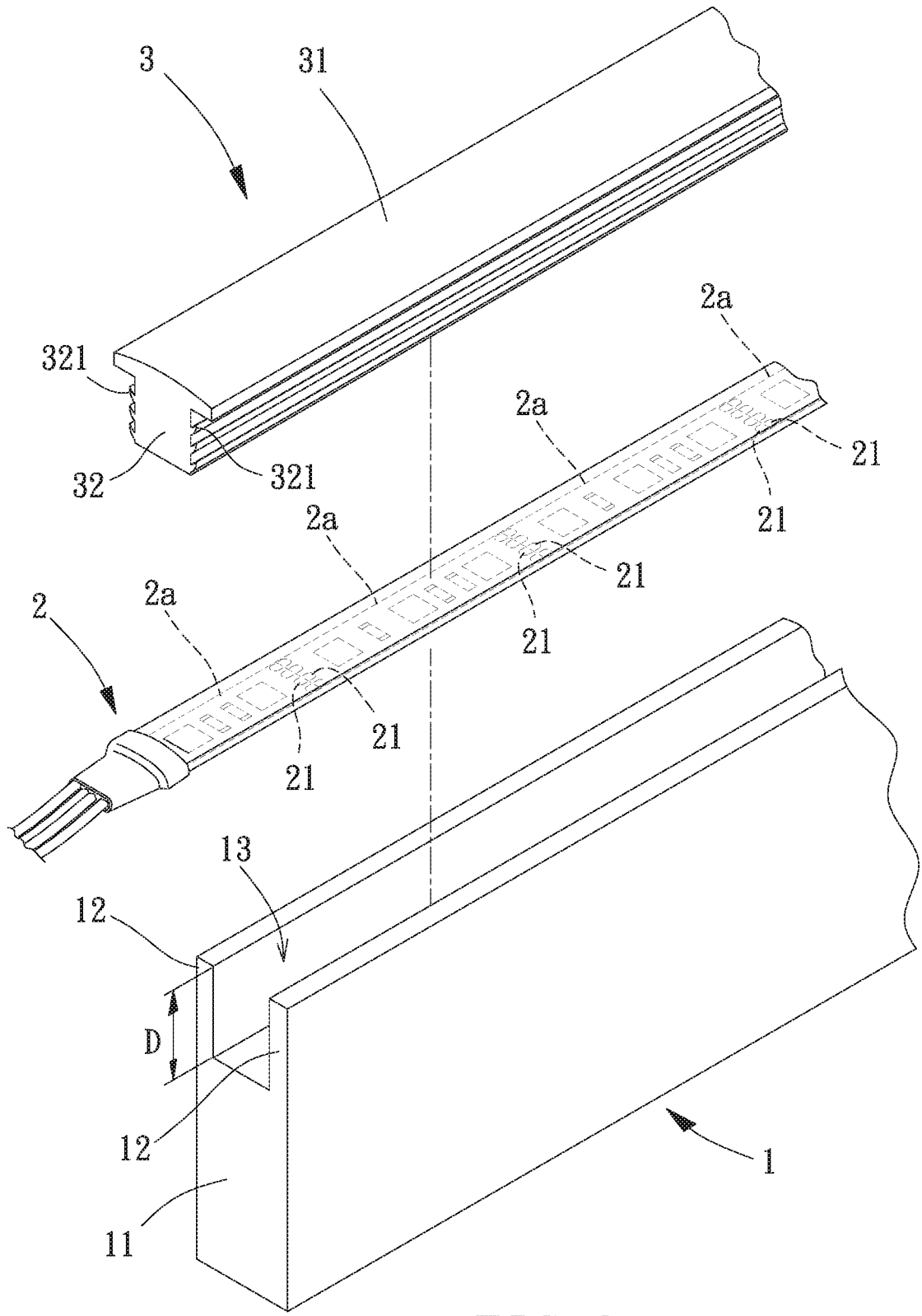
FIG. 2 is a perspective, exploded view of a fixing structure for a light strip according to an embodiment of the invention.

With reference to FIG. 2, a fixing structure for a light strip of a preferred embodiment according to the present invention includes a case 1, a lighting assembly 2 and a light guiding member 3. The lighting assembly 2 is located in the case 1. The light guiding member 3 is coupled with the case 1.

Figure 3:
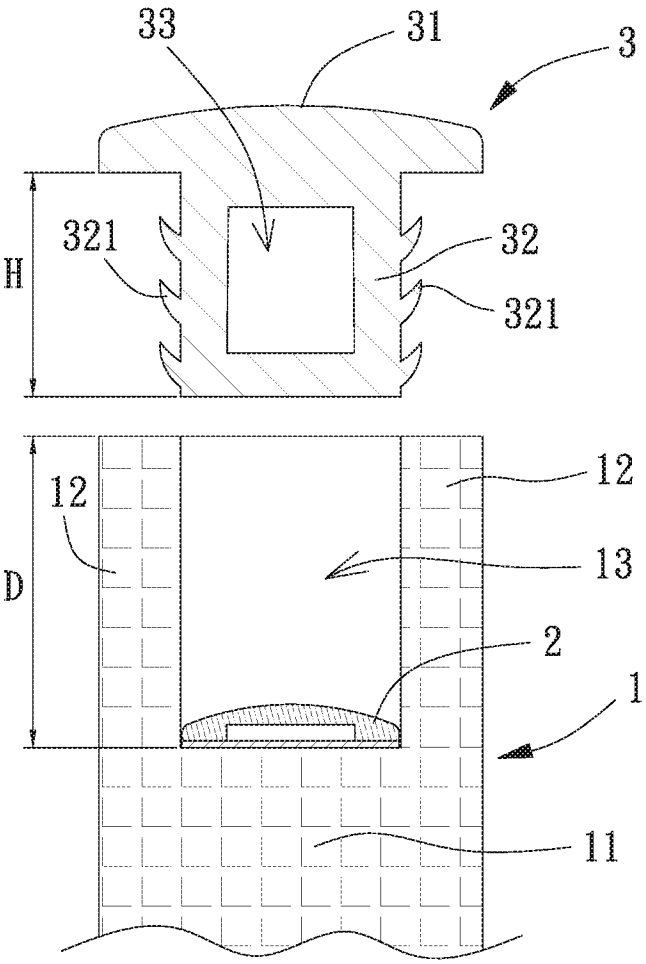
FIG. 3 is a cross sectional view of the fixing structure for the light strip before assembly according to the embodiment of the invention.

With reference to FIGS. 2 and 3, the case 1 includes a base 11 and two side plates 12. The two side plates 12 connect to two long sides of the base 11 respectively. A groove 13 is delimited by the base 11 and the two side plates 12. In this regard, the cross section of the case 1 is substantially in a "U" shape. The groove 13 has a depth D which is formed according to different requirements and is not limited to a specific value. In addition, the base 11 and the two side plates 12 can be connected to each other by ways of adhesion, welding or fusion. The base 11 and the two side plates 12 are formed integrally in this embodiment to enhance the structural strength of the case 1.

The lighting assembly 2 is located in the groove 13 and includes a plurality of interconnected lighting strips 2*a*. The method for interconnecting the plurality of lighting strips 2*a* is not limited in the present invention. In this embodiment, two ends of each of the plurality of lighting strips 2*a* are provided with two connecting portions 21, respectively. The connecting portions 21 of two adjacent lighting strips 2*a* are welded together, thereby connecting the two adjacent lighting strips 2*a* to each other. Accordingly, the plurality of lighting strips 2*a* is connected to each other in series to form the lighting assembly 2. It is noted that the light assembly 2 can emit the light beams with the same or different colors, providing different combinations of the colors of the light.

Figure 4:
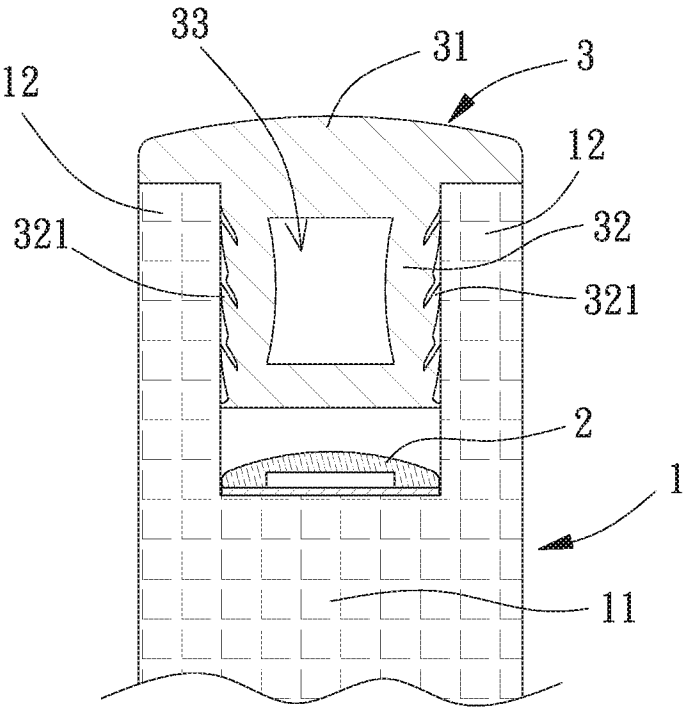
FIG. 4 is a cross sectional view of the fixing structure for the light strip after assembly according to the embodiment of the invention.

With reference to FIG. 4, the light guiding member 3 is received in the groove 13 and can be made of foggy acrylic material. The light guiding member 3 is aligned with and covers the lighting assembly 2, such that the light of the lighting assembly 2 can emit through the light guiding member 3 to generate a halo-like decorative effect or light with different colors while avoiding a dazzling effect resulting from direction emission of the light into the eyes of the user. Furthermore, the light guiding member 3 can have different colors according to different requirements to generate light with different colors.

Specifically, the light guiding member 3 includes a force-applied portion 31 and an insertion portion 32 which is preferably formed with the force-applied portion 31 in an integral manner. The force-applied portion 31 abuts the tops of the two side plates 12. The insertion portion 32 is located in the groove 13 and abuts two inner faces of the two side plates 12. Each of two sides of the insertion portion 32 includes a stopper structure 321 respectively abutting the two inner faces of the two side plates 12. Each of the two stopper structures 321 is in the form of inclined zigzags. In this regard, the light guiding member 3 is firmly received in the groove 13 to close up the groove 13, preventing the light guiding member 3 from sliding relatively to the two side plates 12.

The insertion portion 32 has a height H which is preferably smaller than the depth D of the groove 13 to prevent the insertion portion 32 from making contact with the lighting assembly 2. The light guiding member 3 further includes a hollow portion 33 located in the insertion portion 32. With this arrangement, the insertion portion 32 is flexible and can be inserted into the groove 13 more smoothly.

Figure 5:
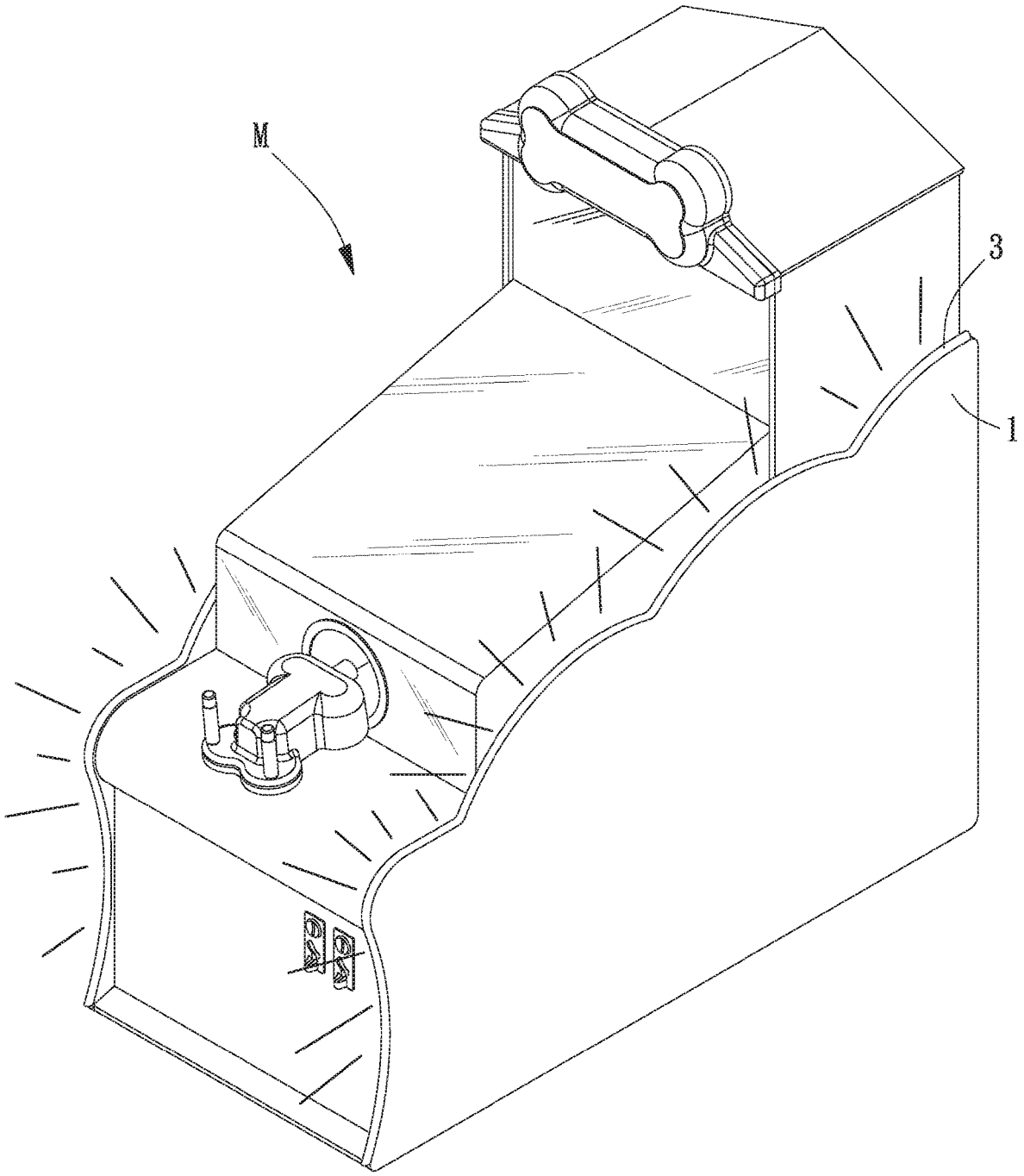
FIG. 5 is a perspective view of the fixing structure for the light strip according to the embodiment which is applied to a game machine.

With reference to FIG. 5, based on the above structure, the fixing structure for the light strip according to the present invention can be applied to a game machine M. In this embodiment, the case 1 is mounted to a wall of the game machine M. The light of the lighting assembly 2, which is mounted inside the case 1, can emit light through the light guiding member 3 to generate a halo-like decorative effect or light with different colors. Therefore, the appearance quality of the game machine M is improved.

Figure 6:
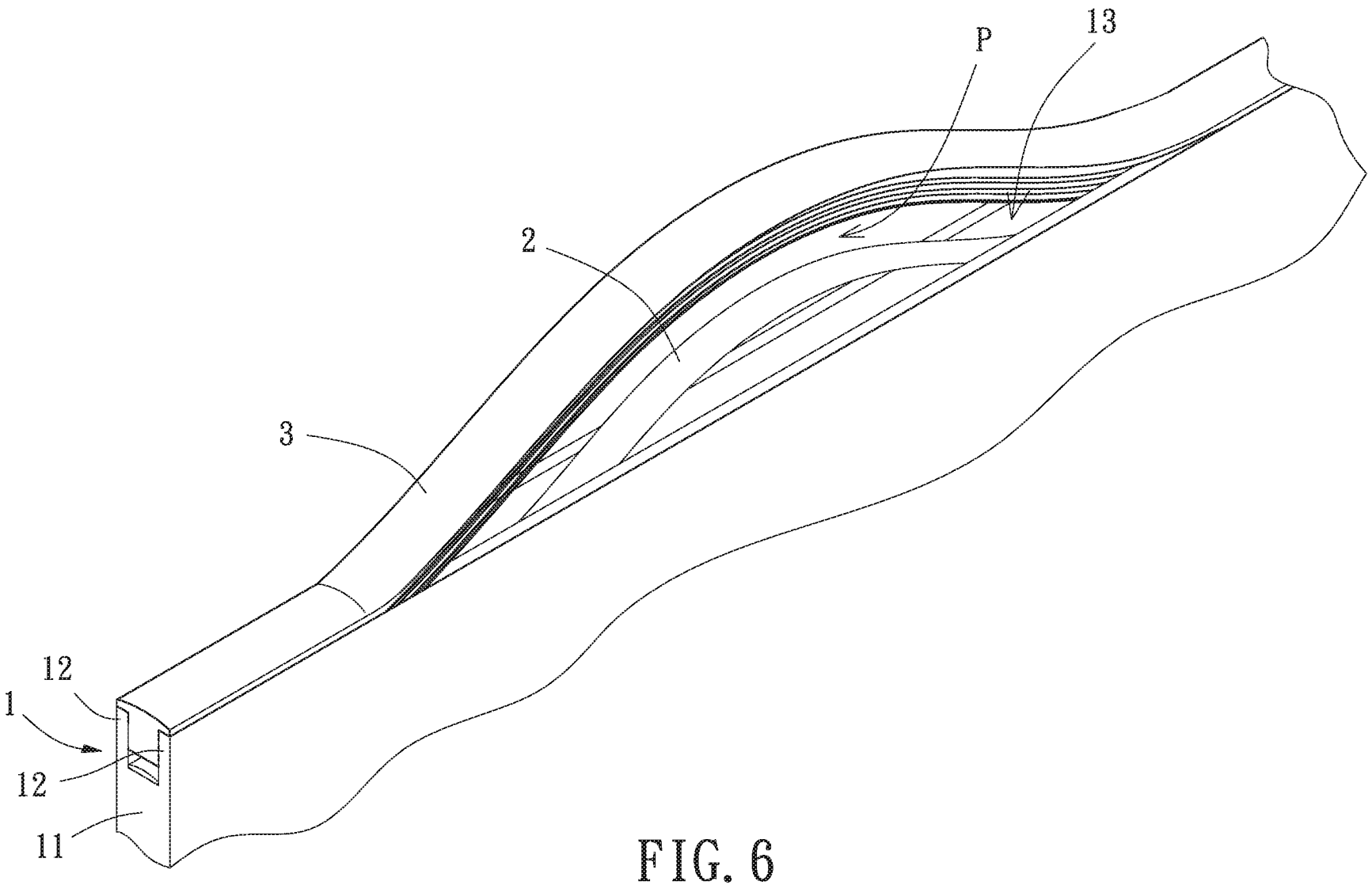
FIG. 6 is an illustrated figure where the fixing structure for the light strip according to the embodiment is being repaired.
Figure 7:
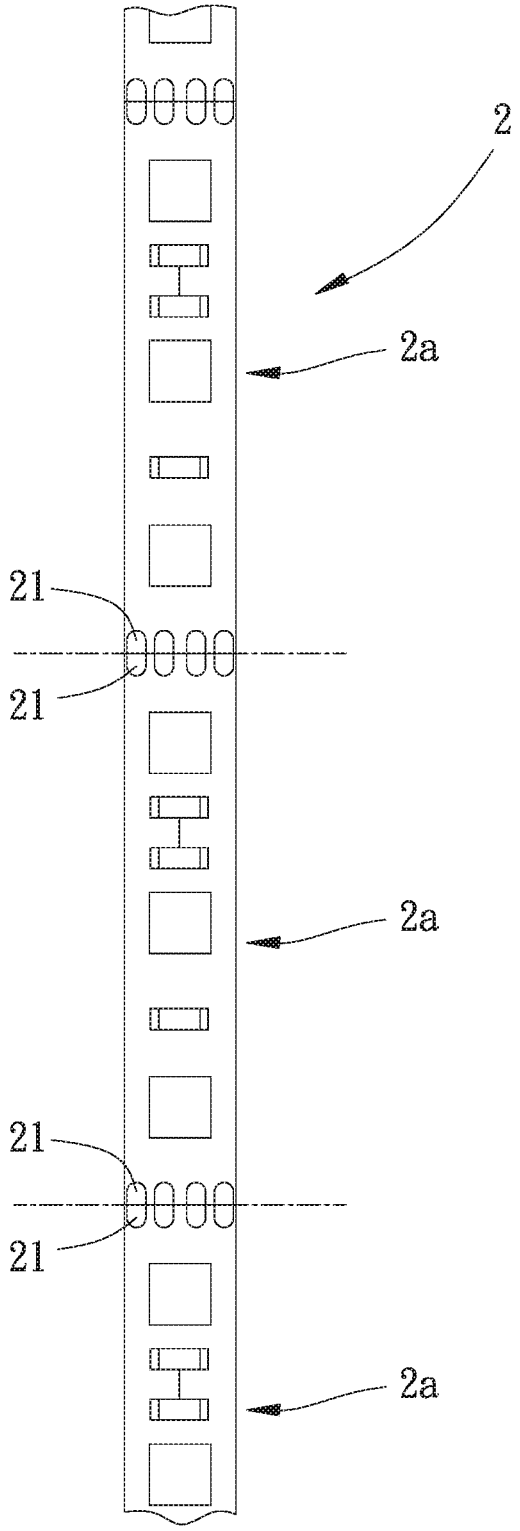
FIG. 7 is a top view of a lighting assembly of the fixing structure for the light strip according to the embodiment of the invention.

With reference to FIGS. 6 and 7, the light guiding member 3 is pulled out of the groove 13 when one of the plurality of the lighting strips 2*a* is broken and requires repair or replacement. For example, the light guiding member 3 can be partially or entirely pulled out of groove 13. The invention is not limited to either option. The invention is also not limited to the drawing. In this embodiment, the light guiding member 3 is partially pulled out of the groove 13 to form a space P between the light guiding member 3 and the case 1.

Then, the broken lighting strip 2*a* is cut off from the normally operating lighting strips 2*a* at the connecting portion 21. At this time, a new lighting strip 2*a* is welded to the normally operating lighting strips 2*a* adjacent to the broken lighting strip 2*a* for replacement purpose. Finally, the light guiding member 3 is inserted back to the groove 13. In this regard, the repairing or replacement process does not require that the entire lighting assembly 2 be pulled out. Thus, the complexity in assembly or maintenance of the fixing structure for the light strip and the labor cost are reduced, leading to a convenient assembly and maintenance.

In view of the foregoing, the fixing structure for the light strip according to the present invention does not require that the entire lighting assembly be pulled out for repair or replacement purposes by providing a light guiding member which is received in the groove and covers the lighting assembly. Thus, the complexity in assembly or maintenance of the fixing structure for the light strip and the labor cost are reduced, leading to a convenient assembly and maintenance.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A fixing structure for a light strip, comprising:

a case provided with a groove, including a base and two side plates, wherein the two side plates respectively connect to two long sides of the base, and wherein the groove is delimited by the base and the two side plates;

a lighting assembly, located in the groove, formed by a plurality of lighting strips connected to each other in series, wherein two ends of each of the plurality of lighting strips are respectively provided with two connecting portions, and one of the two connecting portions of one of the plurality of lighting strips is welded with one of the two connecting portions of another of the plurality of lighting strips adjacent to the one of the plurality of lighting strips; and a light guiding member, received in the groove and covering the lighting assembly, including a force-applied portion and an insertion portion wherein the force-applied portion abuts tops of the two side plates, the insertion portion abuts two inner faces of the two side plates, the light guiding member includes a hollow portion located in the insertion portion, and the light guiding member is made of foggy acrylic material.

2. The fixing structure for the light strip as claimed in claim 1, wherein the base and the two side plates are integrally formed with each other.

3. The fixing structure for the light strip as claimed in claim 1, wherein the groove has a depth, and wherein the insertion portion has a height smaller than the depth.

4. The fixing structure for the light strip as claimed in claim 1, wherein two sides of the insertion portion are respectively provided with two stopper structures, and wherein the two stopper structures respectively abut the two inner faces of the two side plates.

* * * * *